US006452342B1

(12) United States Patent
Ohno

(10) Patent No.: US 6,452,342 B1
(45) Date of Patent: Sep. 17, 2002

(54) SELF-SCANNING LIGHT-EMITTING DEVICE

(75) Inventor: Seiji Ohno, Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 0 days.

(21) Appl. No.: 09/830,283

(22) PCT Filed: Aug. 24, 2000

(86) PCT No.: PCT/JP00/05680

§ 371 (c)(1),
(2), (4) Date: Apr. 25, 2001

(87) PCT Pub. No.: WO01/15905

PCT Pub. Date: Mar. 8, 2001

(30) Foreign Application Priority Data

Aug. 30, 1999 (JP) ..... 11-242653

(51) Int. Cl.[7] ..... G09G 3/10

(52) U.S. Cl. ..... 315/169.1; 347/237; 347/238; 347/247; 347/249

(58) Field of Search ..... 315/169.1; 347/237, 347/247, 224, 238, 248, 249

(56) References Cited

U.S. PATENT DOCUMENTS 5,177,405 A * 1/1993 Kusuda et al. ..... 315/169.1
5,969,744 A * 10/1999 Sakashita et al. ..... 347/237
6,008,833 A * 12/1999 Ohtsubo et al. ..... 347/237

FOREIGN PATENT DOCUMENTS

JP 3-256372 * 11/1991

* cited by examiner

*Primary Examiner*—Don Wong
*Assistant Examiner*—Tuyet T. Vo
(74) *Attorney, Agent, or Firm*—RatnerPrestia

(57) ABSTRACT

A self-scanning light-emitting device is provided in which the number of bonding pads can be decreased, i.e. 2 or 3. The device comprises an array of a plurality of three-terminal light-emitting elements; electrical means having unidirectional characteristic to voltage or current for connecting the control electrodes of neighboring light-emitting elements to each other; two clock pulse lines for applying two-phase clock pulses alternately to one of two terminals except the control electrode of each light-emitting element; and a power supply line connected to each of the control electrodes of the light-emitting elements via a load resistor, respectively. The resistance of the load resistor connected to the light-emitting element to be turned on at first is selected to be smaller than that of other resistors. As a result, the bonding pad for the start pulse may be omitted.

14 Claims, 15 Drawing Sheets

SELF-SCANNING LIGHT-EMITTING DEVICE

TECHNICAL FIELD

The present invention relates to generally a self-scanning light-emitting device, particularly to a self-scanning light-emitting device in which the number of bonding pads can be decreased.

BACKGROUND ART

A light-emitting device in which a plurality of light-emitting elements are arrayed on the same substrate is utilized as a light source of a printer, in combination with a driver circuit. The inventors of the present invention have interested in a three-terminal light-emitting thyristor having a pnpn-structure as an element of the light-emitting device, and have already filed several patent applications (see Japanese Patent Publication Nos. 1-238962, 2-14584, 2-92650, and 2-92651.) These publications have disclosed that a self-scanning function for light-emitting elements may be implemented, and further have disclosed that such self-scanning light-emitting device has a simple and compact structure for a light source of a printer, and has smaller arranging pitch of thyristors.

The inventors have further provided a self-scanning light-emitting device having such structure that an array of light-emitting thyristors having a transfer function is separated from an array of light-emitting thyristor having a write function (see Japanese Patent Publication No. 2-263668.)

Referring to FIG. 1, there is shown an equivalent circuit diagram of a conventional self-scanning light-emitting device. This self-scanning light-emitting device is a type of two-phase driving device. In the figure, reference characters $T_1$, $T_2$, $T_3$ . . . designate light-emitting elements, $D_1$, $D_2$, $D_3$ . . . coupling diodes, $R_1$, $R_2$, $R_3$ load resistors, respectively, the light-emitting elements being consisted of three-terminal light-emitting thyristors. All of the cathodes of the light-emitting elements are connected to the ground, the anodes of odd-numbered light-emitting elements to a clock pulse $\phi$1 line 11, the anode of even-numbered light-emitting elements to a clock pulse $\phi$2 line 12, respectively. Each gate of the light-emitting elements is connected to a power supply voltage $\phi_{GK}$ line 14 via respective load resistor $R_1$, $R_2$, $R_3$ . . . . The gate electrodes of neighboring light-emitting elements are connected to each other via respective coupling diodes $D_1$, $D_2$, $D_3$ . . . . Lines 11, 12 and 14 are derived outward via bonding pads 21, 22 and 24, respectively. The gate of the light-emitting element $T_1$ is connected to the bonding pad 23 for a start pulse $\phi_s$. In the figure, reference numeral 10 shows a chip for the integrated self-scanning light-emitting device.

Bonding pads 21, 22 and 23 are connected to output terminals 41 ($\phi$1), 42($\phi$2) and 43 ($\phi_s$) of a driver circuit 40 via exterior current limiting resistors 51, 52 and 53, respectively, and the bonding pad 24 is directly connected to a output terminal 44 ($\phi_{GK}$) of the driver circuit 40.

Referring to FIG. 2, there is shown the timing of driving pulses $\phi$1, $\phi$2, $\phi_{GK}$ and $\phi_s$ from the driver circuit 40. The levels of each pulse include High level and Low level, Low level being equal to a cathode potential, i.e. a ground potential.

In FIG. 2, L ($T_1$), L ($T_2$), L ($T_3$) . . . show the state of the light emission of the element $T_1$, $T_2$, $T_3$ . . . , the element being emitting state, i.e. on-state at the timing of a shaded area.

The timing diagram of FIG. 2 is illustrated with divided three modes, i.e. MODE-1 (standby mode), MODE-2 (transition mode), and MODE-3 (transfer mode). In the standby mode (MODE-1), all of the light-emitting elements are off-state with $\phi$1, $\phi$2, $\phi_{GK}$ and $\phi_s$ being Low level. Transition mode (MODE-2) has a time duration during which the power supply voltage pulse $\phi_{GK}$ is required to be driven to High level. In the transfer mode (MODE-3), the light-emitting element $T_1$ is turned on when the clock pulse $\phi$1 is driven to High level during the start pulse $\phi_s$ is at Low level. The start pulse $\phi_s$ is turned to High level just after the element $T_1$ is turned on. After the element $T_1$ is turned on, the on-state of the elements is transferred by means of two-phase clock pulses $\phi$1 and $\phi$2.

According to the structure of this conventional self-scanning light-emitting device, four bonding pads 21 ($\phi$1), 22 ($\phi$), 23 ($\phi_s$) and 24 ($\phi_{GK}$) are required in a chip due to the wiring to the driver circuit, consequently it is difficult to make such a chip small.

DISCLOSURE OF INVENTION

The object of the present invention is to provide a self-scanning light-emitting device in which the number of bonding pads in a chip may be decreased to 2 or 3.

According to the present invention, the number of pads in a chip may be decreased in a self-scanning light-emitting device comprising an array of a plurality of three-terminal light-emitting elements linearly arranged each having a control electrode for controlling threshold voltage or current; electrical means having unidirectional characteristic to voltage or current for connecting the control electrodes of neighboring light-emitting elements to each other; two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, and the other phase clock pulse of the two-phase clock pulses causing the light-emitting element neighbored to the turned-on light-emitting element to turn on; and a power supply line connected to each of the control electrodes of the light-emitting elements via a load resistor, respectively.

In order to realize this, the following approaches may be adopted.

(1) The resistance of the load resistor connected to the light-emitting element to be turned on at first is selected to be smaller than that of other resistors. As a result, the bonding pad for a start pulse may be omitted.

(2) A diode or resistor is connected between one of the two clock pulse lines and the control electrode of the light-emitting element to be turned on at first. As a result, the bonding pad for a start pulse may be omitted.

(3) A logical OR circuit consisting of a diode-diode logic is connected between the two clock pulse lines and the power supply line. As a result, the bonding pad for the power supply pulse may be omitted.

(4) A logical OR circuit consisting of a diode-diode logic is connected between the two clock pulse lines and the power supply line, and a diode or resistor is connected between one of the two clock pulse lines and the control electrode of the light-emitting element to be turned on at first. As a result, the bonding pads for the start pulse and the power supply pulse may be omitted.

Also, the present invention is applicable to a type of self-scanning light-emitting device wherein transfer and light emission functions are separated. This type of device comprises an array of a plurality of three-terminal transfer elements linearly arranged each having a control electrode for controlling threshold voltage or current; electrical means having unidirectional characteristic to voltage or current for connecting the control electrodes of neighboring transfer elements to each other; two clock pulse lines for applying two-phase clock pulses alternately to one of two terminals except the control electrode of each transfer element, one phase clock pulse of the two-phase clock pulses causing the threshold voltage or current of the transfer elements in the vicinity of a turned-on transfer element to vary via the electrical means, and the other phase clock pulse of the two-phase clock pulses causing the transfer element neighbored to the turned-on transfer element to turn on; a power supply line connected to each of the control electrodes of the transfer elements via a load resistor, respectively; an array of a plurality of three-terminal light-emitting elements linearly arranged each having a control electrode for controlling threshold voltage or current, each control electrode of the light-emitting elements being connected to corresponding control electrode of the transfer elements; and a write signal line for applying a write signal to one of two terminals except the control electrode of the light-emitting element.

In this self-scanning light-emitting device, the number of the bonding pads may be decreased by applying the approaches (1)–(4) to the part of a transfer function.

BEST MODE FOR CARRYING OUT THE INVENTION

The embodiments of the present invention will now be described with reference to the drawings.

First Embodiment

Figure 1:
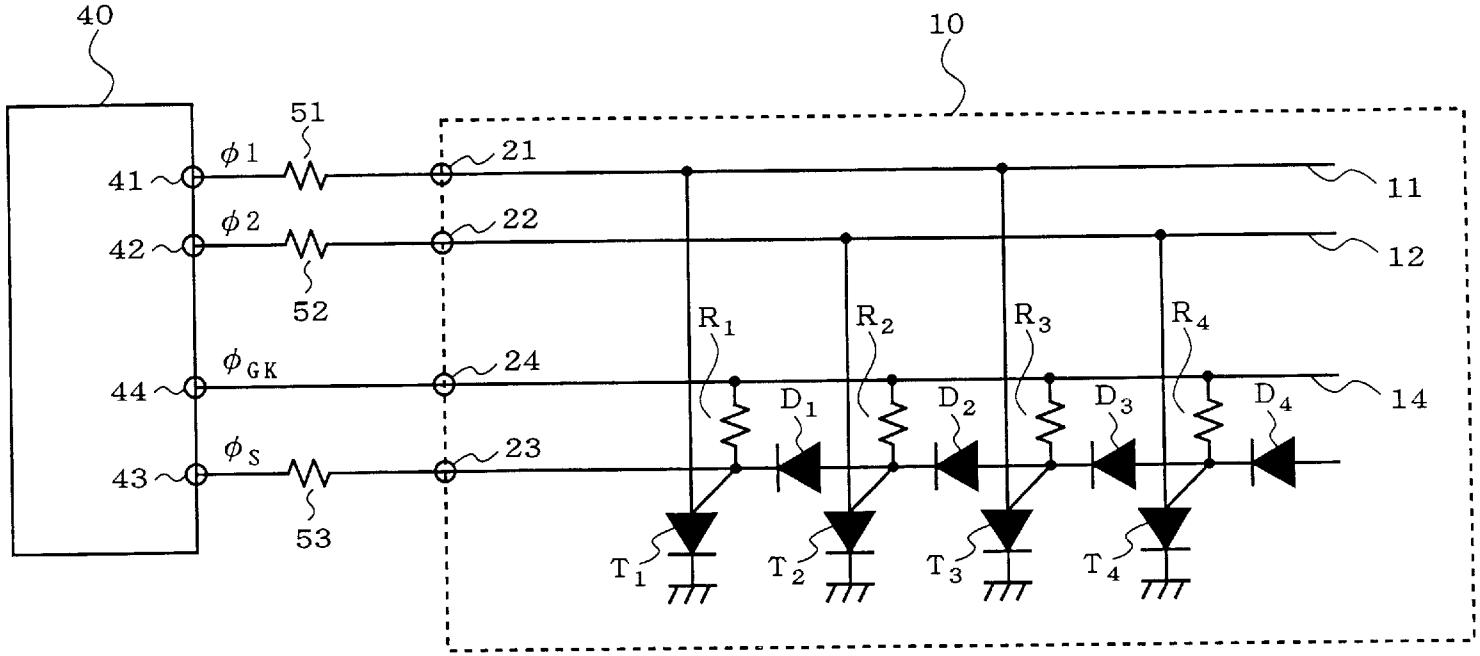
PRIOR ART F I G. 1
FIG. 1 is an equivalent circuit diagram of a conventional self-scanning light-emitting device.
Figure 2:
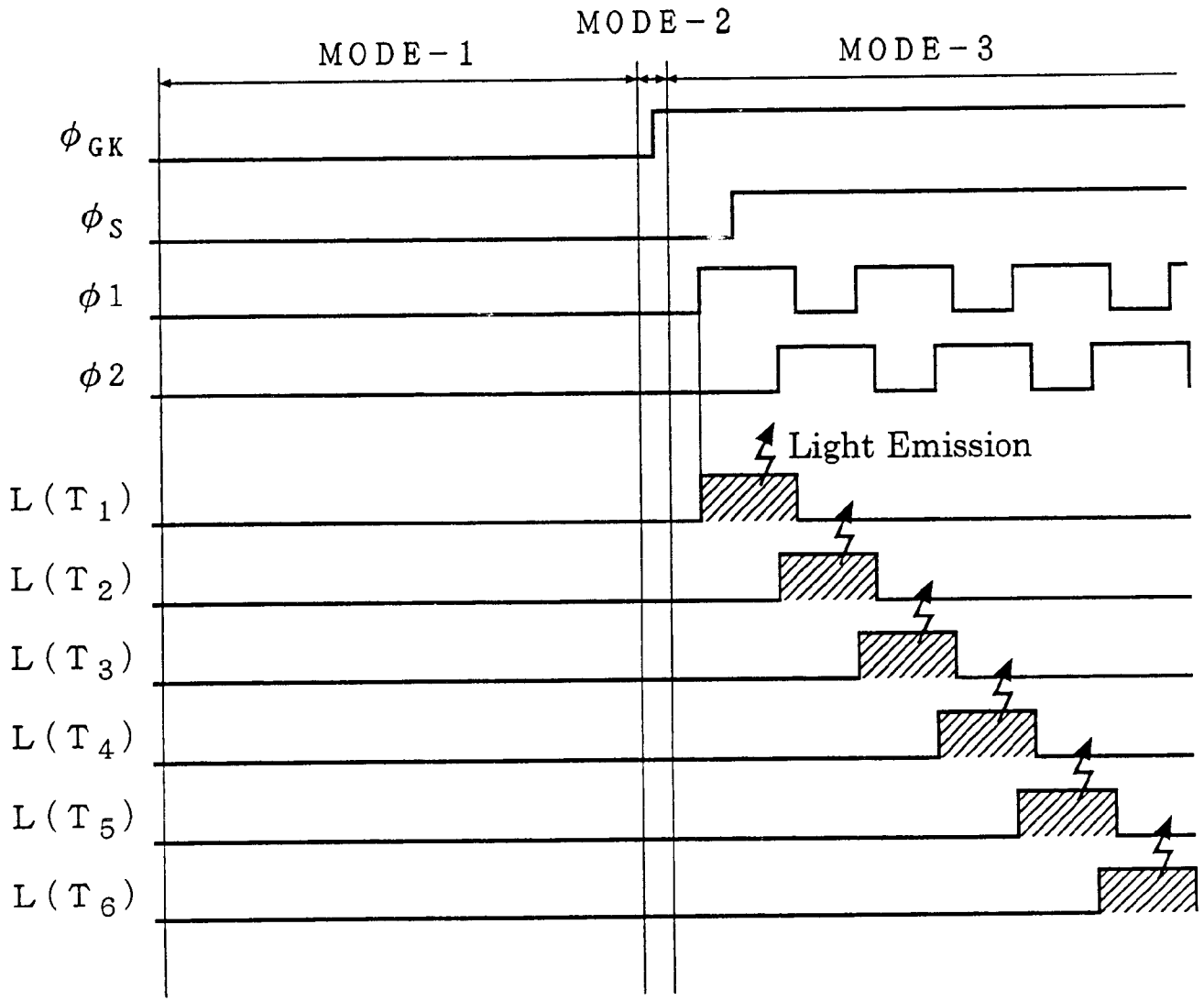
PRIOR ART F I G. 2
FIG. 2 is a timing diagram of driving pulses in the conventional self-scanning light-emitting device.
Figure 3:
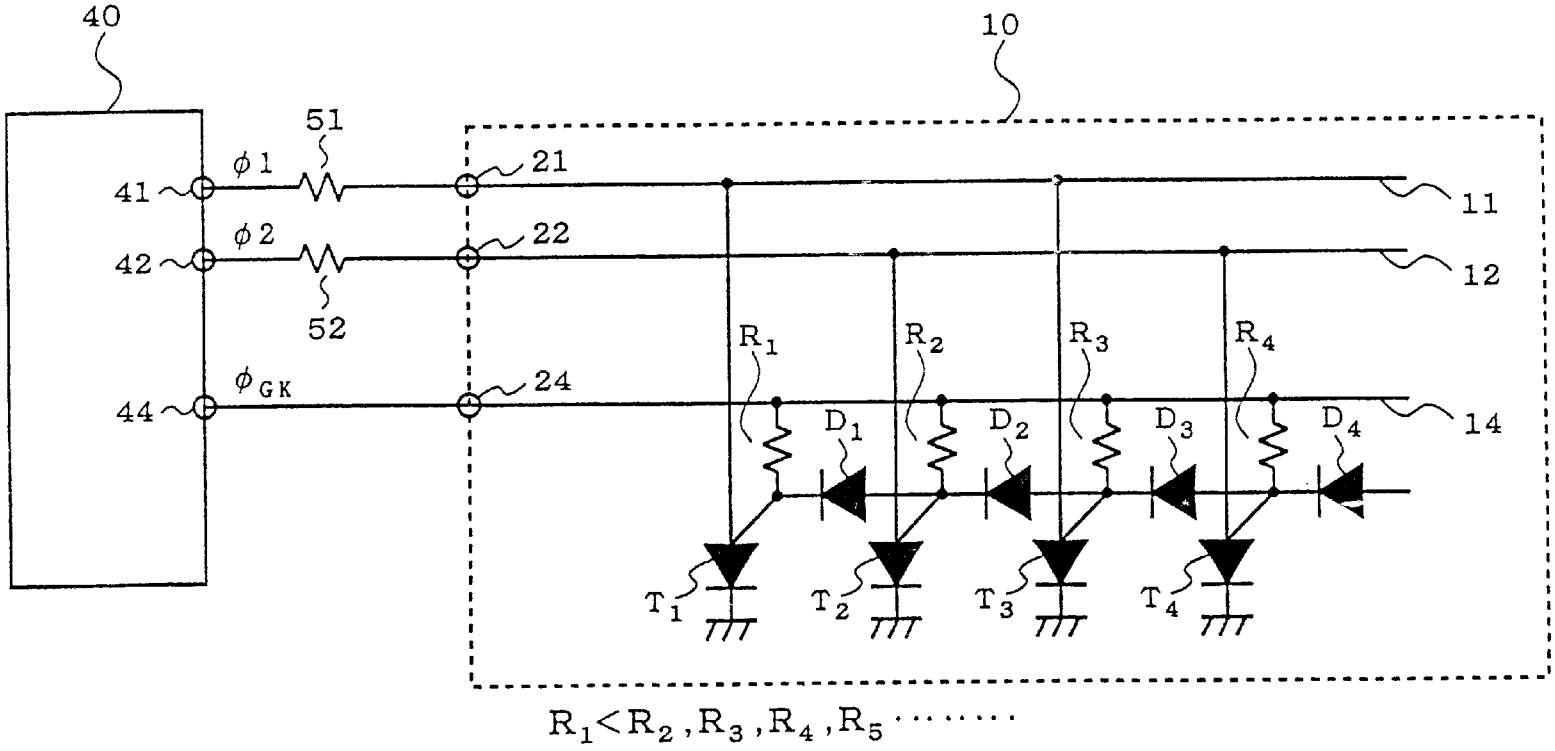
FIG. 3 is a equivalent circuit diagram of a self-scanning light-emitting device of a first embodiment.

Referring to FIG. 3, there is shown an equivalent circuit diagram of a self-scanning light-emitting device of a first embodiment. It should be noted that like components in FIG. 3 are indicated by like reference characters in FIG. 1. In this embodiment, the start pulse $\phi_s$ in FIG. 1 is omitted and its function is realized by the power supply voltage pulse $\phi_{GK}$. In this case, the resistance of the load resistor $R_1$. connected to the light-emitting element $T_1$ is selected to be smaller than respective resistance of the resistors $R_2$, $R_3$ . . . , connected to the light-emitting elements $T_2$, $T_3$ . . . , so that the element $T_1$ is preferentially turned on when the clock pulse $\phi$1 is at High level and the power supply voltage pulse $\phi_{GK}$ is at Low level.

Figure 4:
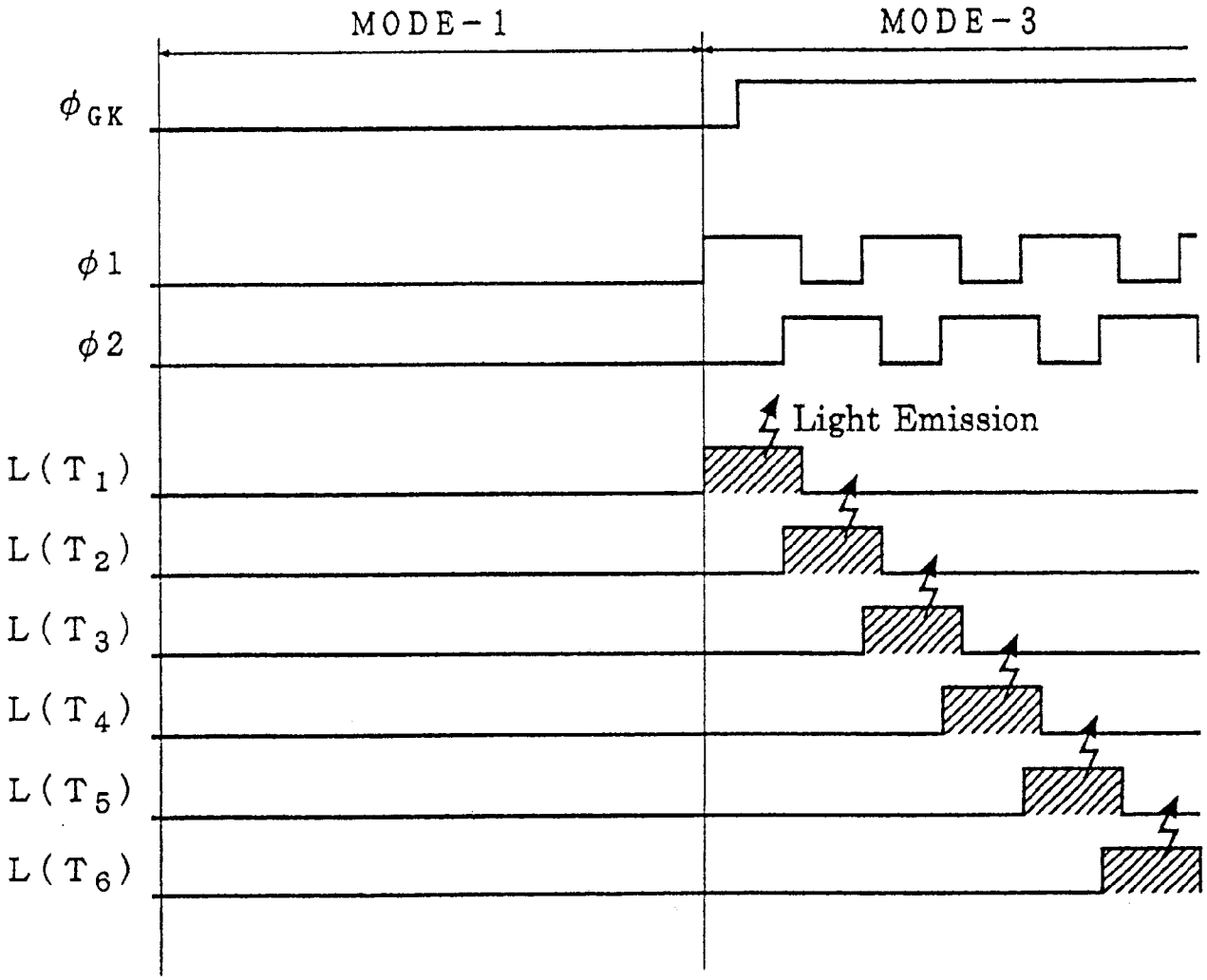
FIG. 4 is a timing diagram of driving pulses in the self-scanning light-emitting device of the first embodiment.

Referring to FIG. 4, there is shown a timing diagram of driving pulses in the self-scanning light-emitting device in FIG. 3. In general, the lower the gate voltage, the shorter the time required for turning on a light-emitting element becomes. The gate voltage is determined by the voltage drop across the load resistor due to a threshold current. Therefore, the smaller the resistance of the load resistor, the shorter the time required to turn on a light-emitting element becomes. As a result, if the resistance of $R_1$ is selected to be smaller than each resistance of $R_2$, $R_3$, . . . , then the light-emitting element $T_1$ is selectively turned on when the clock pulse $\phi_1$ is driven to High level while the power supply pulse voltage $\phi_{GK}$ is at Low level. Once the light-emitting element $T_1$ is turned on, other light-emitting elements can not be turned on. After that, $\phi_{GK}$ is driven to High level, and the self-scanning light-emitting device is operated in a conventional manner.

The difference between the gate voltage of the light-emitting element $T_1$ and that of the light-emitting element $T_2$ is $(R_2-R_1)\times I_{th}$, wherein "$R_1$" and "$R_2$" are the resistances of the resistors $R_1$ and $R_2$, and $I_{th}$ is a threshold current of the light-emitting element. If this voltage difference is larger, the light-emitting element $T_1$ is selectively turned on in a stable manner, so that the resistance $R_1$ is required to be small. However, too small resistance $R_1$ is not permissible, because where the resistance $R_1$ is too small, the light-emitting $T_1$ can not drive the load resistor $R_1$ at High level of $\phi_{GK}$.

According to the present embodiment, the number of bonding pads may be decreased by one pad compared with the self-scanning light-emitting device in FIG. 1, thus decreasing an area of the chip 10.

Second Embodiment

Figure 5:
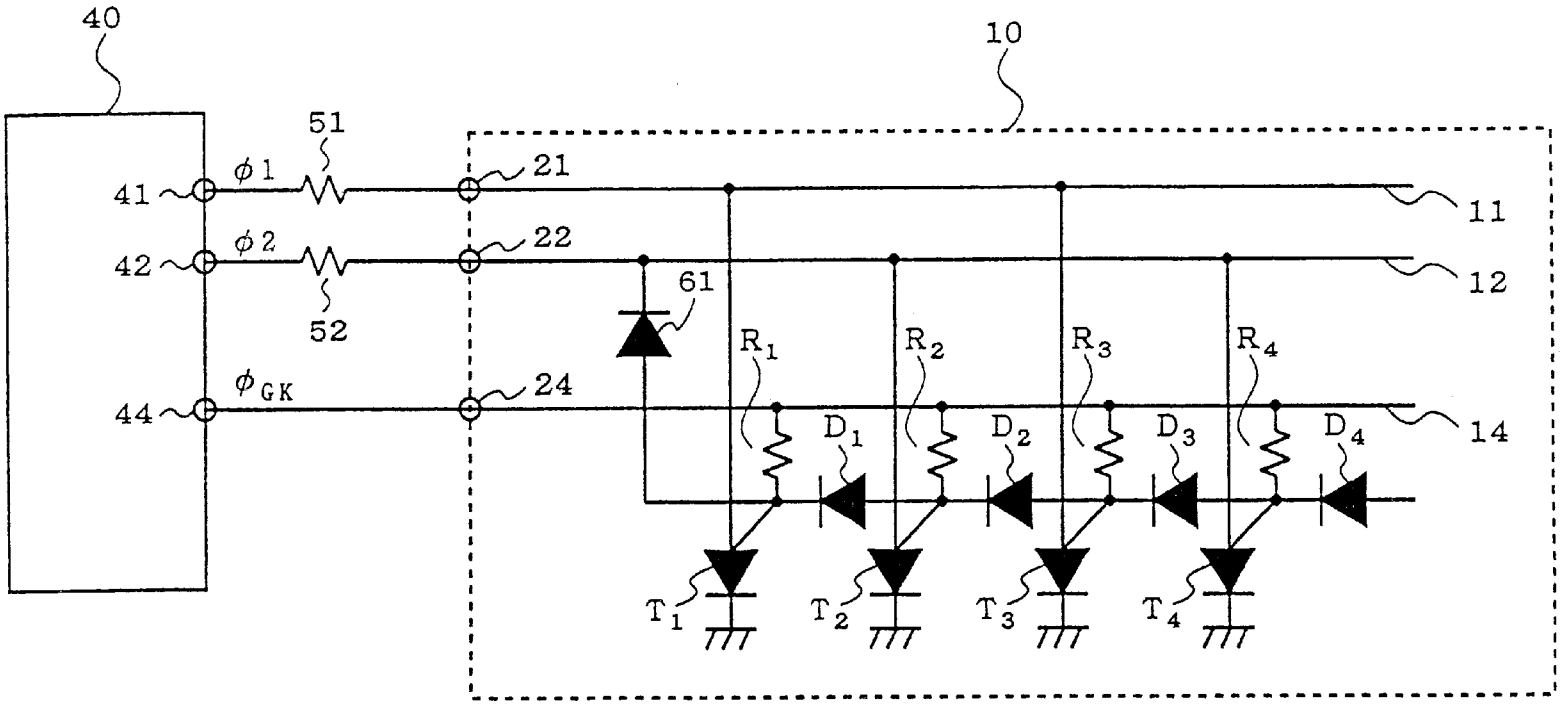
FIG. 5 is a equivalent circuit diagram of a self-scanning light-emitting device of a second embodiment.

In this embodiment, the start pulse $\phi_s$ is omitted in the self-scanning light-emitting device shown in FIG. 1 and its function is realized by the clock pulse $\phi$2. FIG. 5 shows a equivalent circuit diagram of a self-scanning light-emitting device of this embodiment. It should be noted that like components in FIG. 5 are indicated by like reference characters in FIG. 1. In this case, the gate of the light-emitting $T_1$ is connected to the clock pulse $\phi$2 line 12 via one diode 61. Depend upon the level of the gate voltage $V_H$ of the light-emitting element $T_1$, two or more diodes may be connected in series.

Figure 6:
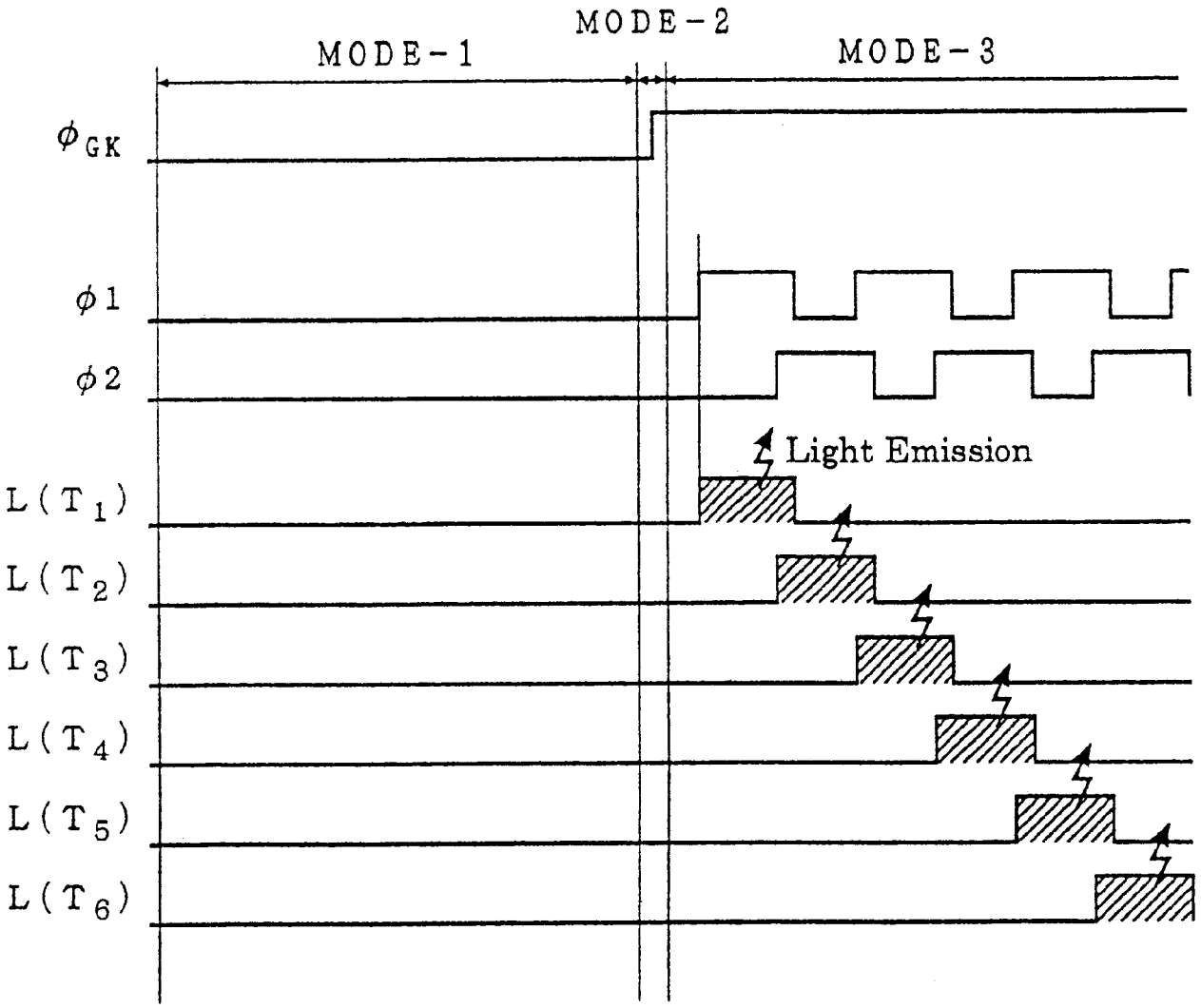
FIG. 6 is a timing diagram of driving pulses in the self-scanning light-emitting device of the second embodiment.

Referring to FIG. 6, there is shown a timing diagram of driving pulses in the self-scanning light-emitting device of the second embodiment. When the clock pulse $\phi$2 is at Low level while all of the light-emitting element are not on-state, the threshold voltage of the light-emitting element $T_1$ is about $2V_D$ ($V_D$ is a diffusion potential of PN junction), and that of the light-emitting element $T_3$ is about $4V_D$. Therefore, when the clock pulse $\phi$1 is pulled up to more than $2V_D$, the light-emitting element $T_1$ is selectively turned on. On the other hand, when the clock pulse $\phi 2$ is at High level to cause an even-numbered light-emitting element $T_{2n}$ (n is a natural number) connected to the line 12 to turn on, the threshold voltage to turn on an odd-numbered light-emitting element $T_{2n+1}$ is about $2V_D$, and the threshold voltage of the light-emitting element $T_1$ is $(V_H+2V_D)$, therefore the threshold voltage of the light-emitting element $T_{2n+1}$ becomes the lowest voltage. As a result, the clock pulse $\phi 1$ is driven to High level, then the light-emitting element $T_{2n+1}$ is selectively turned on. After that, even if the clock pulse $\phi 2$ is driven to Low level, the light-emitting element $T_1$ is not turned on because the threshold voltage of the element $T_1$ is $2V_D$, which is higher than the voltage (about $V_D$) of the clock pulse $\phi 1$ when the element $T_{2n+1}$ is turned on.

According to the present embodiment, the number of bonding pads may be decreased by one pad compared with the self-scanning light-emitting device in FIG. 1.

Third Embodiment

Figure 7:
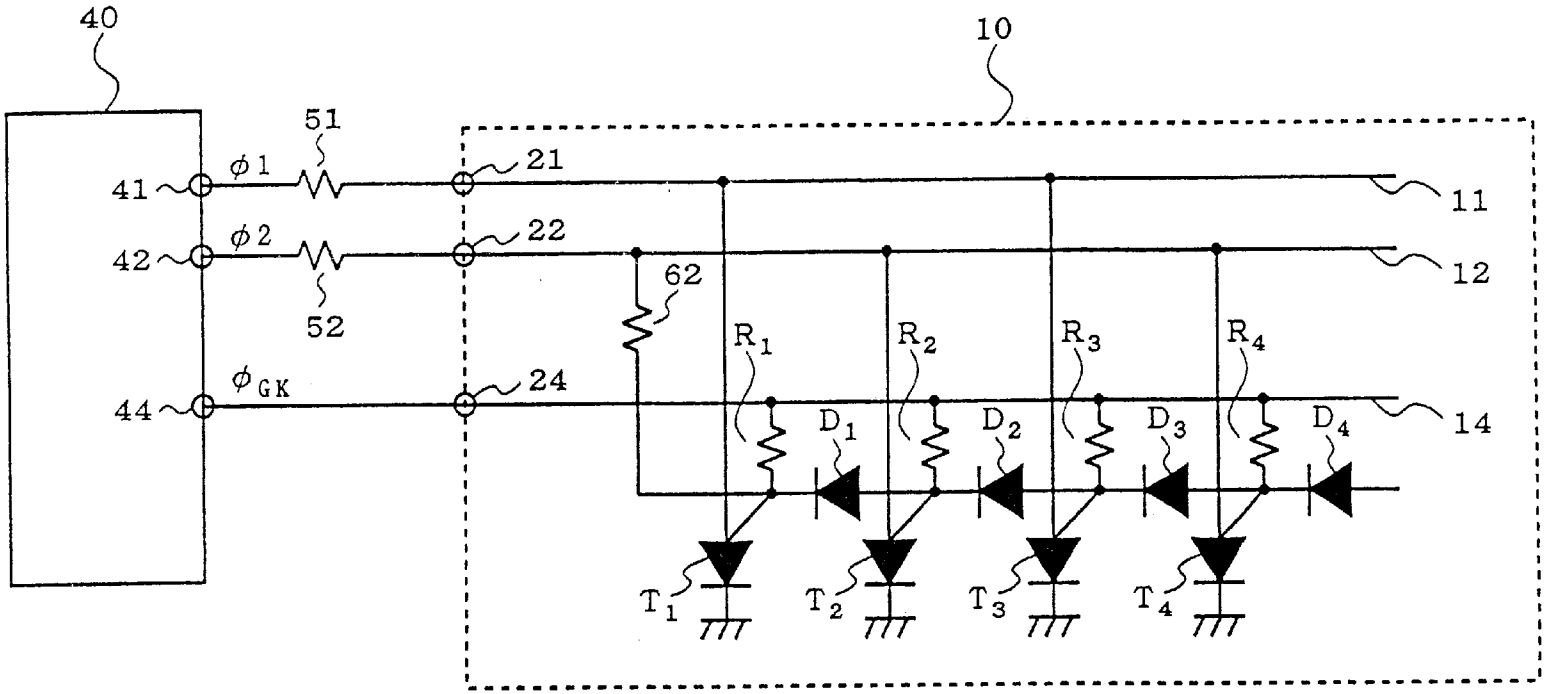
FIG. 7 is a equivalent circuit diagram of a self-scanning light-emitting device of a third embodiment.

In this embodiment, the diode 61 in the second embodiment in FIG. 5 is replaced by a resistor. FIG. 7 shows a equivalent circuit diagram of a self-scanning light-emitting device of this embodiment. It should be noted that like components in FIG. 7 are designated by like characters in FIG. 1. The gate of the light-emitting element $T_1$ is connected to the clock pulse $\phi 2$ line 12 via a resistor 62.

This embodiment realizes the same function as the embodiment of FIG. 5 by utilizing the voltage drop across the resistor 62 (the resistance thereof is $R_s$) by a threshold current in place of the diffusion voltage of the diode 61 in FIG. 5. That is, when the clock pulse $\phi 2$ is at Low level while all of the light-emitting element are not on-state, the threshold voltage of the light-emitting element $T_1$ is about $(V_D+R_S\times I_{th})$, and that of the light-emitting element $T_3$ is about $(3V_D+R_S\times I_{th})$. Therefore, when the voltage of the clock pulse $\phi 1$ is pulled up more than $(V_D+R_S\times I_{th})$, the light-emitting element $T_1$ is selectively turned on. On the other hand, when the clock pules $\phi 2$ is at High level to cause an even-numbered light-emitting element $T_{2n}$ (n is a natural number) connected to the line 12 to turn on, the threshold voltage to turn on an odd-numbered light-emitting element $T_{2n+1}$ is about $2V_D$, and the threshold voltage of the light-emitting element $T_1$ is $(V_H+V_D+R_S\times I_{th})$, therefore the threshold voltage of the light-emitting element $T_{2n+1}$ becomes the lowest voltage. As a result, the clock pulse $\phi 1$ is driven to High level, then the light-emitting element $T_{2n+1}$ is selectively turned on.

Fourth Embodiment

Figure 8:
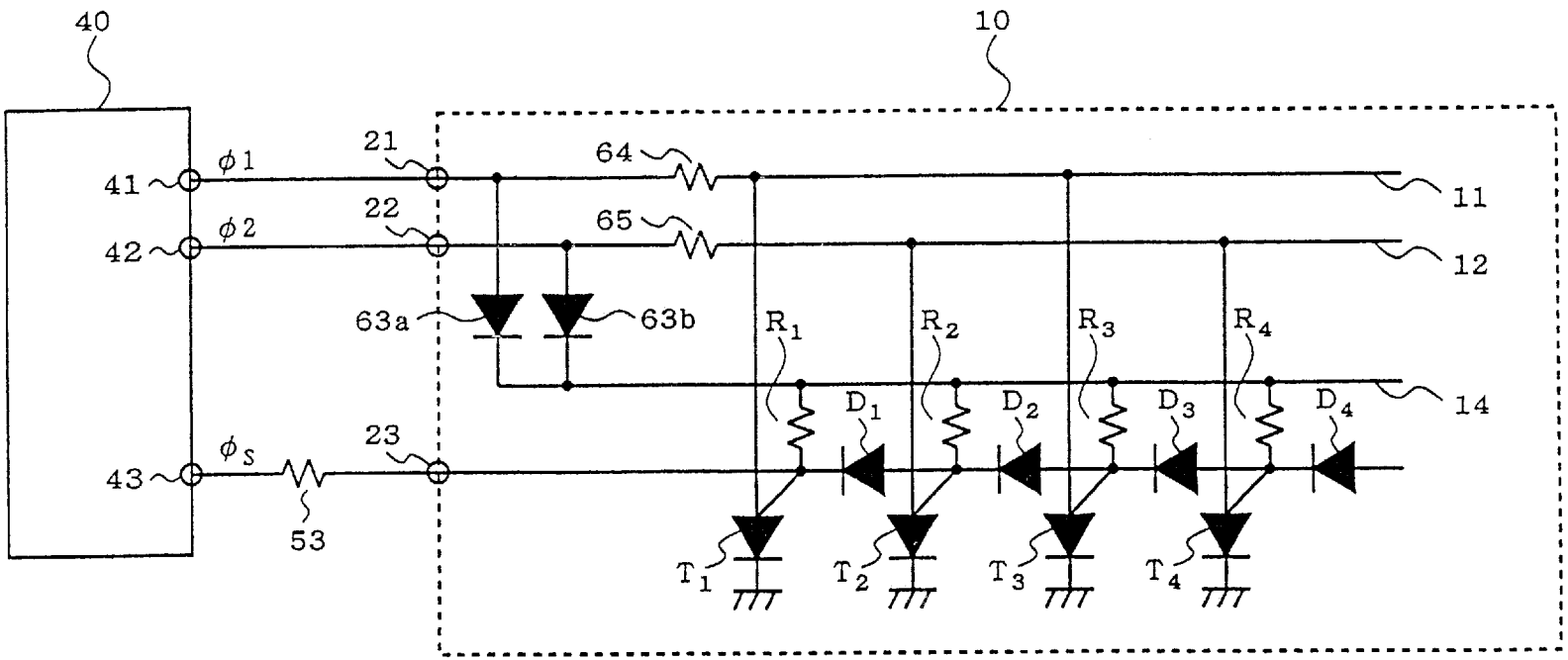
FIG. 8 is a equivalent circuit diagram of a self-scanning light-emitting device of a fourth embodiment.

The power supply voltage pulse $\phi_{GK}$ is supplied from the driver circuit 40 in the self-scanning light-emitting device in FIG. 1, but it is synthesized from the clock pulse $\phi 1$ and $\phi 2$ in a fourth embodiment. FIG. 8 shows a equivalent circuit diagram of a self-scanning light-emitting device of the fourth embodiment. It should be noted that like components in FIG. 8 are designated by like reference characters in FIG. 1.

In this embodiment, the power supply voltage pulse $\phi_{GK}$ line 14 is connected to the clock pulse $\phi 1$, $\phi 2$ lines 11 and 12 via diodes 63*a* and 63*b*, respectively. The voltage V(14) of the line 14 is synthesized as a logical OR of the clock pulse $\phi 1$ and $\phi 2$. In this case, a logical OR circuit consisting of diode-diode logic (DDL) is used. To obtain the synthesized voltage V(14), any one of levels of the clock pulse $\phi 1$ and $\phi 2$ must be at High level after a light-emitting element is turned on. For this purpose, the exterior current limiting resistors 51 and 52 in the first, second and third embodiments are mounted in the chip 10. The resistors mounted in the chip are designated by reference numerals 64 and 65.

Figure 9:
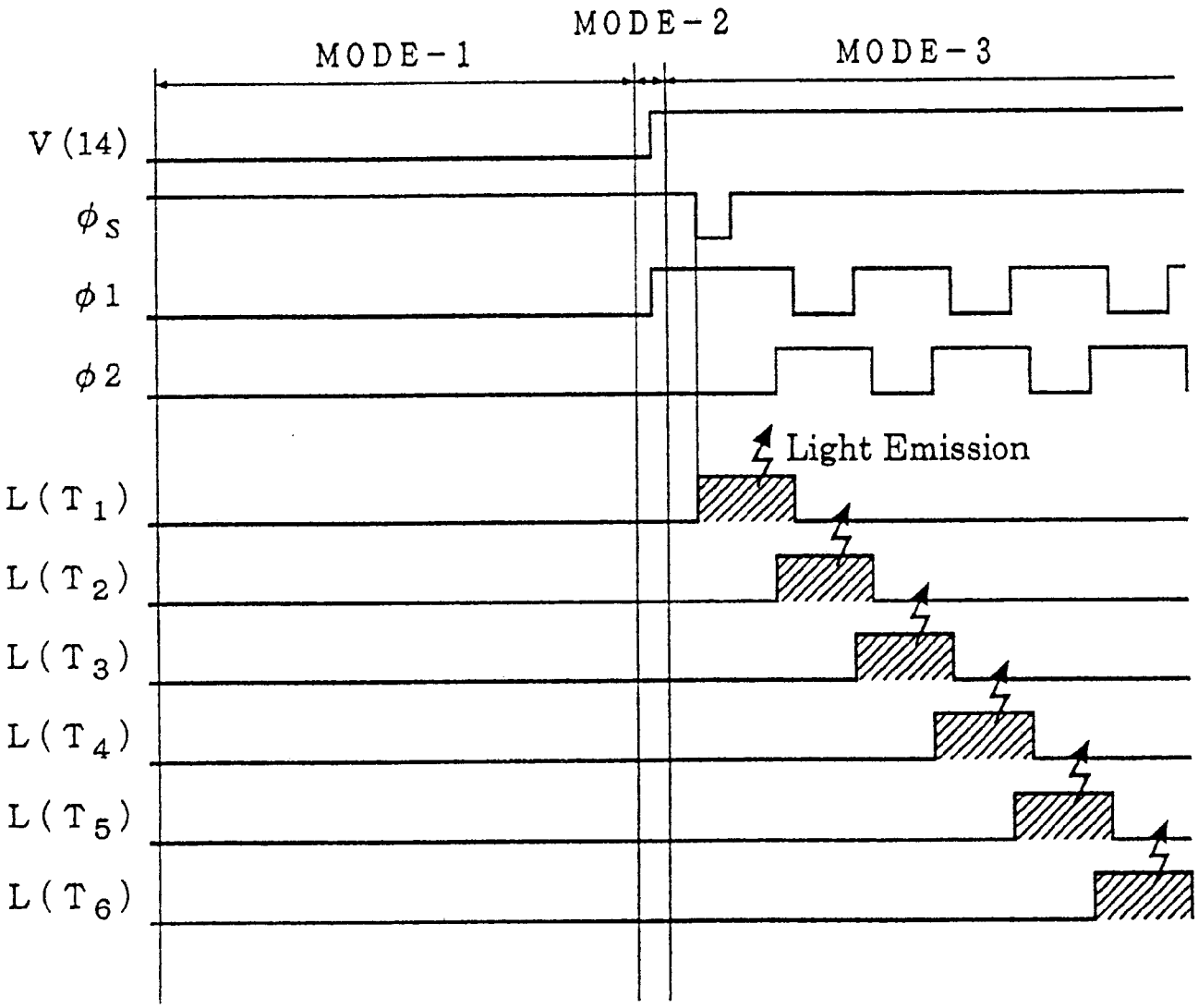
FIG. 9 is a timing diagram of driving pulses in the self-scanning light-emitting device of the fourth embodiment.

Referring to FIG. 9, there is shown a timing diagram of driving pulses in the self-scanning light-emitting device of the fourth embodiment. When the clock pulse $\phi 1$ is driven to High level during the transition mode (MODE-2), the voltage V(14) of the line 14 becomes High level, then the power supply voltage is applied to the light-emitting elements. When the start pulse $\phi_s$ is driven from High level to Low level in the transfer mode (MODE-3), the light-emitting element $T_1$ is turned on. Just after that, the start pulse $\phi_s$ is returned to High level.

Fifth Embodiment

Figure 10:
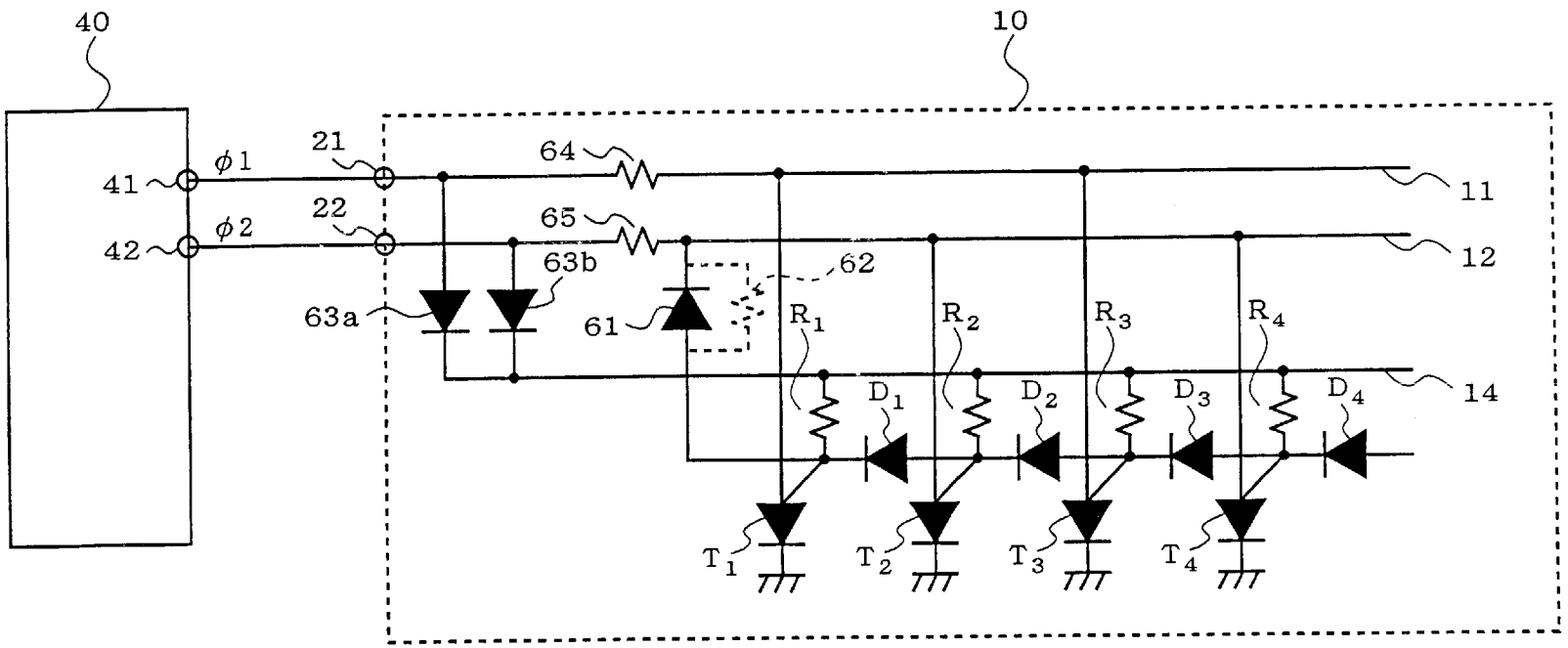
FIG. 10 is a equivalent circuit diagram of a self-scanning light-emitting device of a fifth embodiment.

This embodiment is directed to a combination of the second embodiment in FIG. 5 and the fourth embodiment in FIG. 8. FIG. 10 shows an equivalent circuit of a self-scanning light-emitting device of the present embodiment. Like components in FIG. 10 are designated by like reference characters in FIGS. 5 and 8.

Figure 11:
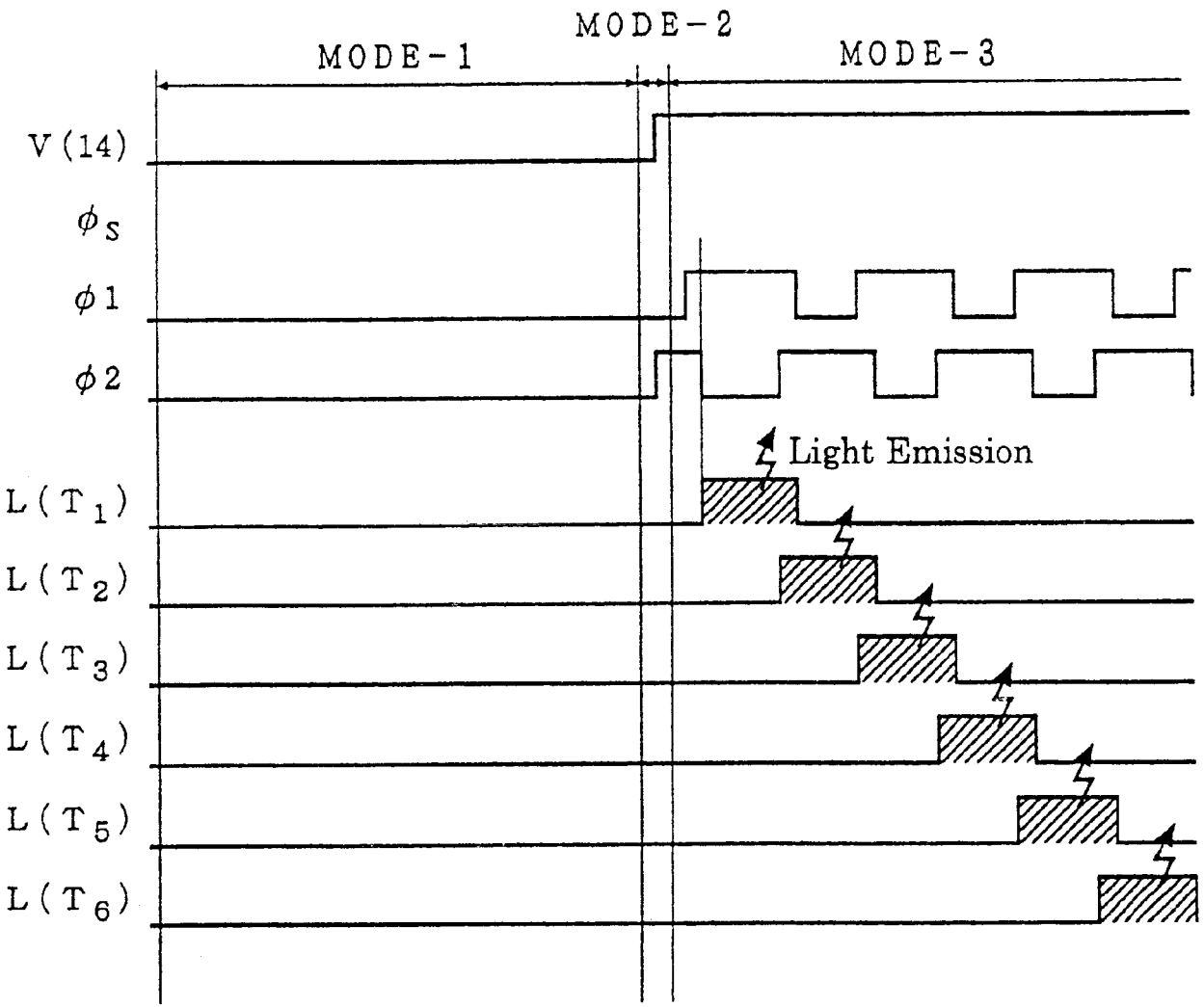
FIG. 11 is a timing diagram of driving pulses in the self-scanning light-emitting device of the fifth embodiment.

Referring to FIG. 11 there is shown the timing of driving pulses in this embodiment. When the clock pulse $\phi 2$ is driven to High level during the transition mode (MODE-2), the voltage V(14) becomes High level to apply a power supply voltage to light-emitting elements. Then, the light-emitting element $T_1$ is turned on when the clock pulse $\phi 2$ is at Low level.

Figure 12:
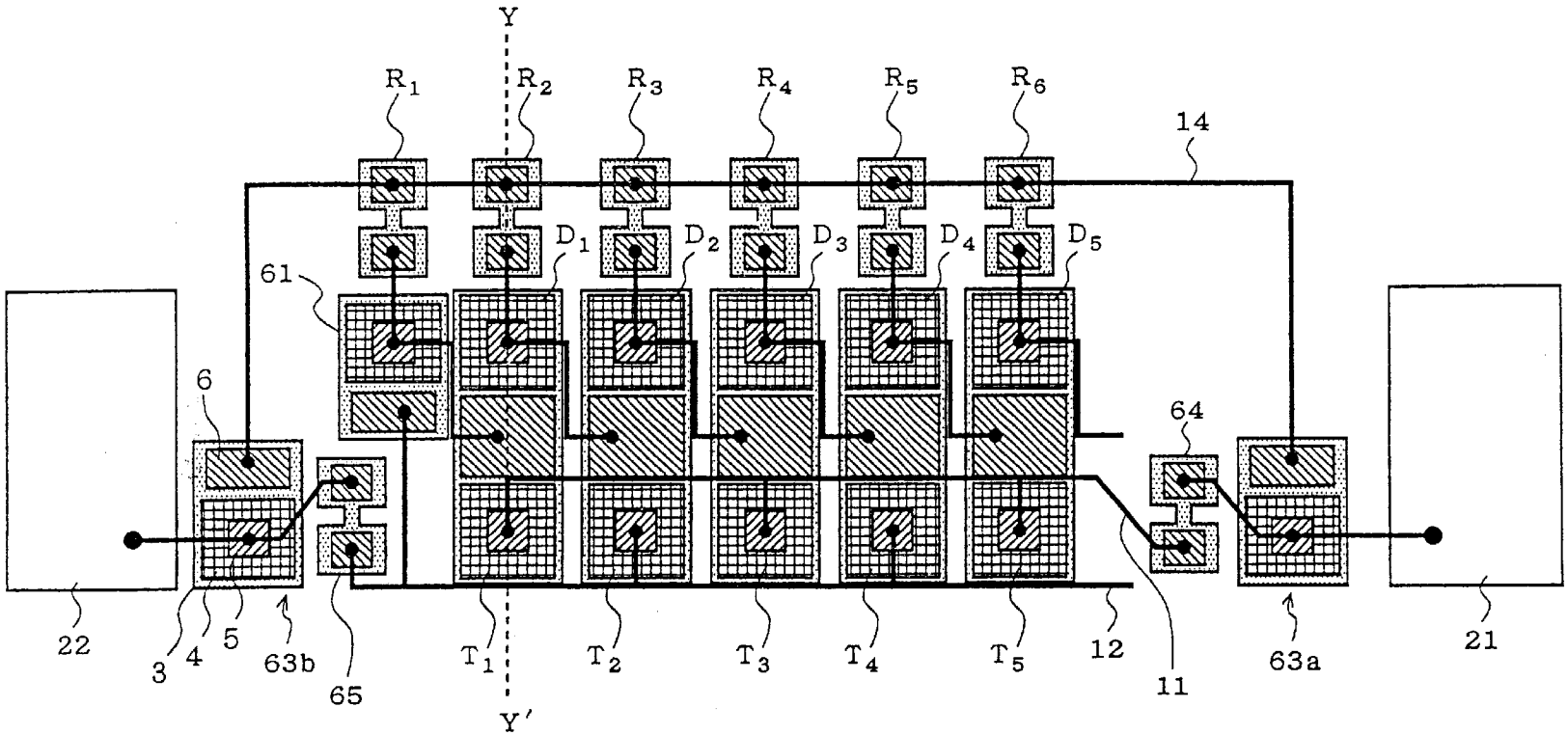
FIG. 12 is a plan view of an example of integrated self-scanning light-emitting device of FIG. 10.
Figure 13:
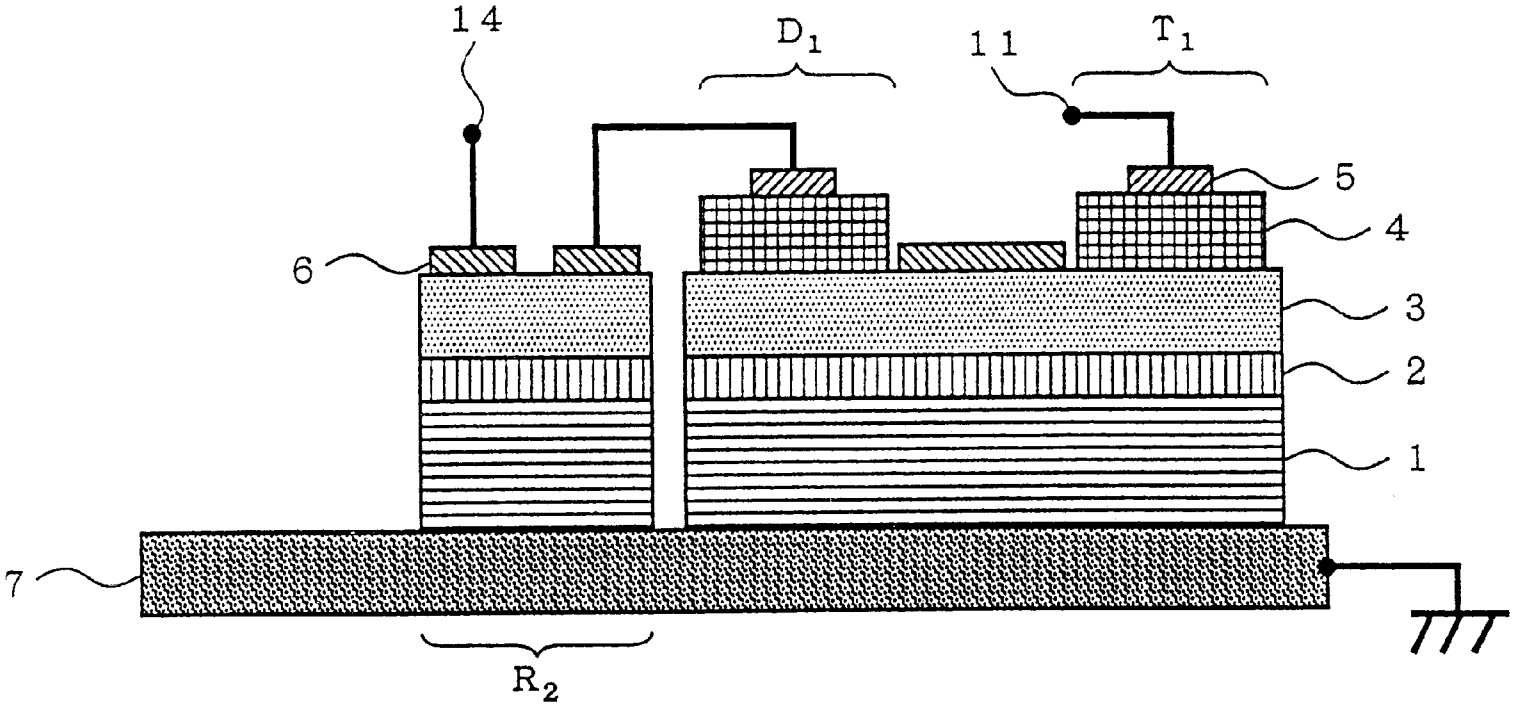
FIG. 13 is a cross sectional view taken along a Y–Y' line in FIG. 12.

Referring to FIG. 12, there is shown a plan view of an example of integrated self-scanning light-emitting device of FIG. 10. FIG. 13 is a cross sectional view taken along a Y–Y' line in FIG. 12. Like components in FIGS. 12 and 13 are designated by like reference characters in FIG. 10. As shown in FIG. 13, the load resistor $R_2$, coupling diode $D_1$, and light-emitting element $T_1$ are formed from the structure in which a first conductivity type layer 1, a second conductivity type layer 2, a first conductivity type layer 3, and a second conductivity type layer 4 are sequentially stacked on a first conductivity type substrate 7. In the figures, reference numeral 5 designates an anode electrode of the light-emitting element $T_1$, reference numeral 6 an electrode of the load resistor $R_2$.

Apparent from FIG. 12, there is only bonding pads 21 and 22 for clock pulse $\phi 1$ and $\phi 2$, so that the area of the chip 10 may be further decreased.

In this embodiment, it is noted that the resistor 62 may be used in place of the diode 61 as shown in FIG. 10.

Sixth Embodiment

Figure 14:
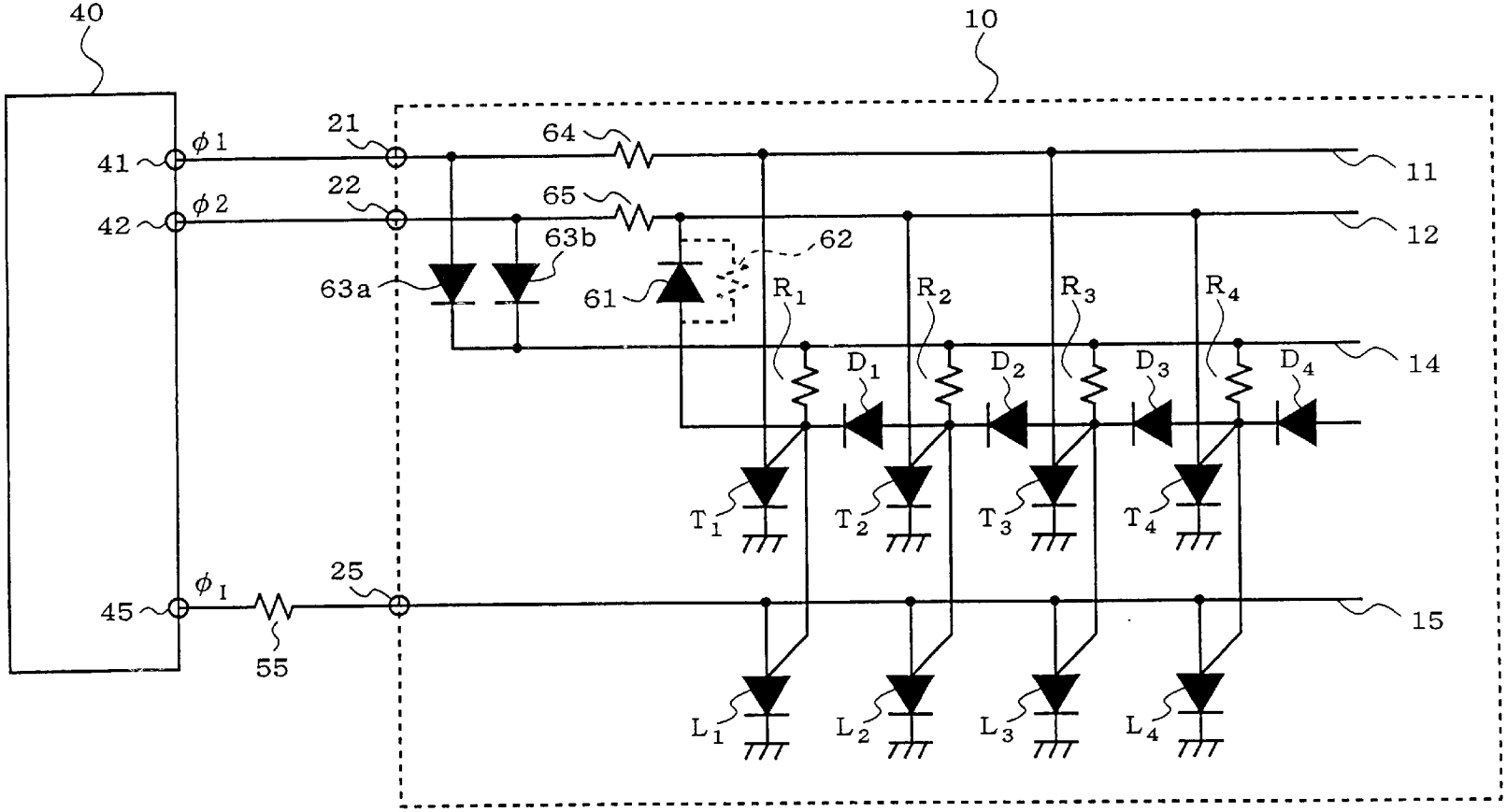
FIG. 14 is a equivalent circuit diagram of a self-scanning light-emitting device of a sixth embodiment.

Referring to FIG. 14, there is a equivalent circuit diagram of a self-scanning light-emitting device of a sixth embodiment. This embodiment has a structure that a transfer function is realized utilizing the circuit of the fifth embodiment in FIG. 10, which is separated from a light emission function. That is, the transfer function is realized by using the light-emitting elements $T_1$, $T_2$, $T_3$, . . . transfer elements, and light emission function is realized by the light-emitting elements $L_1$, $L_2$, $L_3$, . . . . The gates of transfer elements $T_1$, $T_2$, $T_3$, . . . are correspondingly connected to the gates of the light-emitting elements, the anodes thereof are connected to a write signal $\phi_I$ line 15. The line 15 is connected to a output terminal ($\phi_I$) 45 of the driver circuit 40 via an exterior resistor 55.

The gate of the transfer element turned on becomes about 0 volts, so that the corresponding light-emitting element may be turned on if the voltage of the write signal $\phi_I$ is larger than a diffusion potential of PN junction. In order to transfer the turn-on state to next transfer element, the voltage of the write signal is once dropped to 0 volts to turn-off the light-emitting element turned on.

Figure 15:
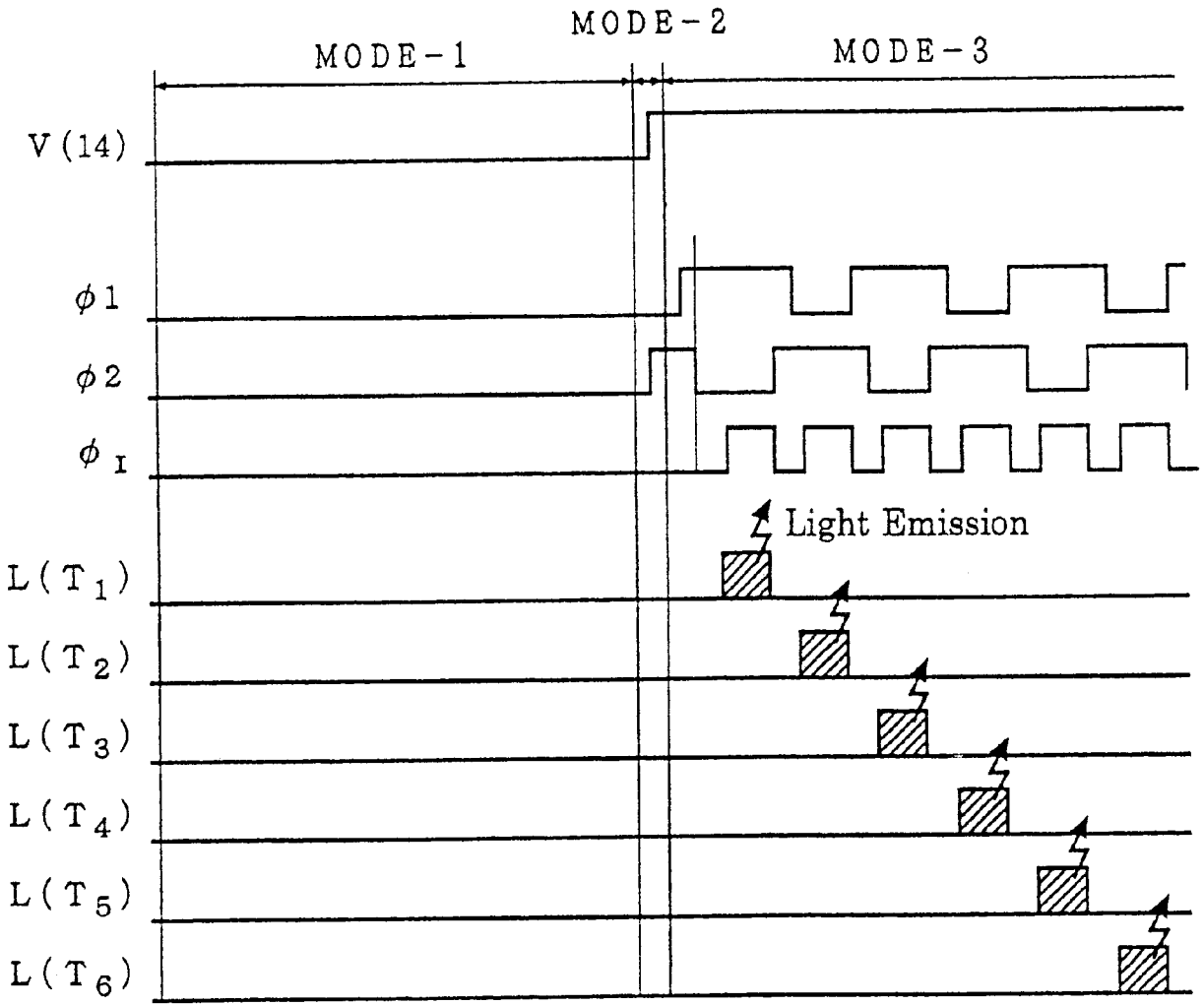
FIG. 15 is a timing diagram of driving pulses in the self-scanning light-emitting device of the sixth embodiment.

FIG. 15 shows the timing of driving pulses in this embodiment. It would be understood from the figure that the light-emitting elements $T_1$, $T_2$, $T_3$, . . . are turned on depending upon High level of the write signal $\phi_I$.

In this embodiment, it is noted that the resistor 62 may be used in place of the diode 61 as shown in FIG. 14.

It is easily understood for those who skilled in the art that the structure wherein the transfer function and the light emission function are separated is applicable to the first to fourth embodiments.

INDUSTRIAL APPLICABILITY

According to the present invention described above, the number of bonding pads provided in a chip may be decreased, so that it is possible to make the size of a chip small.

What is claimed is:

1. A self-scanning light-emitting device, comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, and the other phase clock pulse of the two-phase clock pulses causing the light-emitting element neighbored to the turned-on light-emitting element to turn on; and a power supply line connected to each of the control electrodes of the light-emitting elements via a load resistor, respectively;

wherein the resistance of the load resistor connected to the light-emitting element to be turned on at first is selected to be smaller than respective resistance of other load resistors.

2. A self-scanning light-emitting device, comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, and the other phase clock pulse of the two-phase clock pulses causing the light-emitting element neighbored to the turned-on light-emitting element to turn on;

a power supply line connected to each of the control electrodes of the light-emitting elements via a load resistor, respectively; and a diode connected between one of the two clock pulse lines and the control electrode of the light-emitting element to be turned on at first.

3. A self-scanning light-emitting device, comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, and the other phase clock pulse of the two-phase clock pulses causing the light-emitting element neighbored to the turned-on light-emitting element to turn on;

a power supply line connected to each of the control electrodes of the light-emitting elements via a load resistor, respectively; and a resistor connected between one of the two clock pulse lines and the control electrode of the light-emitting element to be turned on at first.

4. A self-scanning light-emitting device, comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, and the other phase clock pulse of the two-phase clock pulses causing the light-emitting element neighbored to the turned-on light-emitting element to turn on;

a power supply line connected to each of the control electrodes of the light-emitting elements via a load resistor, respectively; and a logical OR circuit consisting of a diode-diode logic connected between the two clock pulse lines and the power supply line.

5. A self-scanning light-emitting device, comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, and the other phase clock pulse of the two-phase clock pulses causing the light-emitting element neighbored to the turned-on light-emitting element to turn on;

a power supply line connected to each of the control electrodes of the light-emitting elements via a load resistor, respectively;

a logical OR circuit consisting of a diode-diode logic connected between the two clock pulse lines and the power supply line; and a diode connected between one of the two clock pulse lines and the control electrode of the light-emitting element to be turned on at first.

6. A self-scanning light-emitting device, comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, and the other phase clock pulse of the two-phase clock pulses causing the light-emitting element neighbored to the turned-on light-emitting element to turn on;

a power supply line connected to each of the control electrodes of the light-emitting elements via a load resistor, respectively;

a logical OR circuit consisting of a diode-diode logic connected between the two clock pulse lines and the power supply line; and a resistor connected between one of the two clock pulse lines and the control electrode of the light-emitting element to be turned on at first.

7. The self-scanning light-emitting device of any one of claims 1–6, wherein the three-terminal light-emitting element is a three-terminal light-emitting thyristor.

8. A self-scanning light-emitting device, comprising:

an array of a plurality of three-terminal transfer elements linearly arranged each having a control electrode for controlling threshold voltage or current;

electrical means having unidirectional characteristic to voltage or current for connecting the control electrodes of neighboring transfer elements to each other;

two clock pulse lines for applying two-phase clock pulses alternately to one of two terminals except the control electrode of each transfer element, one phase clock pulse of the two-phase clock pulses causing the threshold voltage or current of the transfer elements in the vicinity of a turned-on transfer element to vary via the electrical means, and the other phase clock pulse of the two-phase clock pulses causing the transfer element neighbored to the turned-on transfer element to turn on;

a power supply line connected to each of the control electrodes of the transfer elements via a load resistor, respectively;

an array of a plurality of three-terminal light-emitting elements linearly arranged each having a control electrode for controlling threshold voltage or current, each control electrode of the light-emitting elements being connected to corresponding control electrode of the transfer elements; and a write signal line for applying a write signal to one of two terminals except the control electrode of the light-emitting element;

wherein the resistance of the load resistor connected to the transfer element to be turned on at first is selected to be smaller than that of other resistors.

9. A self-scanning light-emitting device, comprising:

an array of a plurality of three-terminal transfer elements linearly arranged each having a control electrode for controlling threshold voltage or current;

electrical means having unidirectional characteristic to voltage or current for connecting the control electrodes of neighboring transfer elements to each other;

two clock pulse lines for applying two-phase clock pulses alternately to one of two terminals except the control electrode of each transfer element, one phase clock pulse of the two-phase clock pulses causing the threshold voltage or current of the transfer elements in the vicinity of a turned-on transfer element to vary via the electrical means, and the other phase clock pulse of the two-phase clock pulses causing the transfer element neighbored to the turned-on transfer element to turn on;

a power supply line connected to each of the control electrodes of the transfer elements via a load resistor, respectively;

an array of a plurality of three-terminal light-emitting elements linearly arranged each having a control electrode for controlling threshold voltage or current, each control electrode of the light-emitting elements being connected to corresponding control electrode of the transfer elements;

a write signal line for applying a write signal to one of two terminals except the control electrode of the light-emitting element; and a diode connected between one of the two clock pulse lines and the control electrode of the transfer element to be turned on at first.

10. A self-scanning light-emitting device, comprising:

an array of a plurality of three-terminal transfer elements linearly arranged each having a control electrode for controlling threshold voltage or current;

electrical means having unidirectional characteristic to voltage or current for connecting the control electrodes of neighboring transfer elements to each other;

two clock pulse lines for applying two-phase clock pulses alternately to one of two terminals except the control electrode of each transfer element, one phase clock pulse of the two-phase clock pulses causing the threshold voltage or current of the transfer elements in the vicinity of a turned-on transfer element to vary via the electrical means, and the other phase clock pulse of the two-phase clock pulses causing the transfer element neighbored to the turned-on transfer element to turn on;

a power supply line connected to each of the control electrodes of the transfer elements via a load resistor, respectively;

an array of a plurality of three-terminal light-emitting elements linearly arranged each having a control electrode for controlling threshold voltage or current, each control electrode of the light-emitting elements being connected to corresponding control electrode of the transfer elements; and a write signal line for applying a write signal to one of two terminals except the control electrode of the light-emitting element; and a resistor connected between one of the two clock pulse lines and the control electrode of the transfer element to be turned on at first.

11. A self-scanning light-emitting device, comprising an array of a plurality of three-terminal transfer elements linearly arranged each having a control electrode for controlling threshold voltage or current;

electrical means having unidirectional characteristic to voltage or current for connecting the control electrodes of neighboring transfer elements to each other;

two clock pulse lines for applying two-phase clock pulses alternately to one of two terminals except the control electrode of each transfer element, one phase clock pulse of the two-phase clock pulses causing the threshold voltage or current of the transfer elements in the vicinity of a turned-on transfer element to vary via the electrical means, and the other phase clock pulse of the two-phase clock pulses causing the transfer element neighbored to the turned-on transfer element to turn on;

a power supply line connected to each of the control electrodes of the transfer elements via a load resistor, respectively;

an array of a plurality of three-terminal light-emitting elements linearly arranged each having a control electrode for controlling threshold voltage or current, each control electrode of the light-emitting elements being connected to corresponding control electrode of the transfer elements;

a write signal line for applying a write signal to one of two terminals except the control electrode of the light-emitting element; and a logical OR circuit consisting of a diode-diode logic connected between the two clock pulse lines and the power supply line.

12. A self-scanning light-emitting device, comprising:

an array of a plurality of three-terminal transfer elements linearly arranged each having a control electrode for controlling threshold voltage or current;

electrical means having unidirectional characteristic to voltage or current for connecting the control electrodes of neighboring transfer elements to each other;

two clock pulse lines for applying two-phase clock pulses alternately to one of two terminals except the control electrode of each transfer element, one phase clock pulse of the two-phase clock pulses causing the threshold voltage or current of the transfer elements in the vicinity of a turned-on transfer element to vary via the electrical means, and the other phase clock pulse of the two-phase clock pulses causing the transfer element neighbored to the turned-on transfer element to turn on;

a power supply line connected to each of the control electrodes of the transfer elements via a load resistor, respectively;

an array of a plurality of three-terminal light-emitting elements linearly arranged each having a control electrode for controlling threshold voltage or current, each control electrode of the light-emitting elements being connected to corresponding control electrode of the transfer elements;

a write signal line for applying a write signal to one of two terminals except the control electrode of the light-emitting element;

a logical OR circuit consisting of a diode-diode logic connected between the two clock pulse lines and the power supply line; and a diode connected between one of the two clock pulse lines and the control electrode of the transfer element to be turned on at first.

13. A self-scanning light-emitting device, comprising:

an array of a plurality of three-terminal transfer elements linearly arranged each having a control electrode for controlling threshold voltage or current;

electrical means having unidirectional characteristic to voltage or current for connecting the control electrodes of neighboring transfer elements to each other;

two clock pulse lines for applying two-phase clock pulses alternately to one of two terminals except the control electrode of each transfer element, one phase clock pulse of the two-phase clock pulses causing the threshold voltage or current of the transfer elements in the vicinity of a turned-on transfer element to vary via the electrical means, and the other phase clock pulse of the two-phase clock pulses causing the transfer element neighbored to the turned-on transfer element to turn on;

a power supply line connected to each of the control electrodes of the transfer elements via a load resistor, respectively;

an array of a plurality of three-terminal light-emitting elements linearly arranged each having a control electrode for controlling threshold voltage or current, each control electrode of the light-emitting elements being connected to corresponding control electrode of the transfer elements;

a write signal line for applying a write signal to one of two terminals except the control electrode of the light-emitting element;

a logical OR circuit consisting of diode-diode logic connected between the two clock pulse lines and the power supply line; and a resistor connected between one of the two clock pulse lines and the control electrode of the transfer element to be turned on at first.

14. The self-scanning light-emitting device of any one of claims 8–13, wherein the three-terminal transfer element and three-terminal light-emitting element is a three-terminal light-emitting emitting thyristor, respectively.

* * * * *

UNITED STATES PATENT AND TRADEMARK OFFICE

CERTIFICATE OF CORRECTION

PATENT NO. : 6,452,342 B1
DATED : September 17, 2002
INVENTOR(S) : Seiji Ohno

It is certified that error appears in the above-identified patent and that said Letters Patent is hereby corrected as shown below:

Column 1,
Line 37, "$D_3$...coupling diodes, $R_1$, $R_2$, $R_3$" should read -- $D_3$...coupling diodes, $R_1$, $R_2$, $R_3$… --.

Column 2,
Line 17, "22 (ϕ)," should read -- 22 (ϕ2), --.

Column 4,
Line 9, "In this case, the resistance of the load resister $R_1$. connected" should read -- In this case, the resistance of the load resister $R_1$ connected --.

Column 11,
Line 1, "11. A self-scanning light-emitting device, comprising an" should read -- 11. A self-scanning light-emitting device, comprising: an --.

Signed and Sealed this

Ninth Day of September, 2003

JAMES E. ROGAN
*Director of the United States Patent and Trademark Office*